US012453408B2

(12) United States Patent
Forbes et al.

(10) Patent No.: US 12,453,408 B2
(45) Date of Patent: Oct. 28, 2025

(54) CLEANER HEAD FOR A VACUUM CLEANER

(71) Applicant: Dyson Technology Limited, Wiltshire (GB)

(72) Inventors: Steven John Forbes, Swindon (GB); Andrew Paul Fussell, Newport (GB)

(73) Assignee: Dyson Technology Limited, Malmesbury (GB)

( * ) Notice: Subject to any disclaimer, the term of this patent is extended or adjusted under 35 U.S.C. 154(b) by 193 days.

(21) Appl. No.: 17/280,028

(22) PCT Filed: Sep. 26, 2019

(86) PCT No.: PCT/GB2019/052724
§ 371 (c)(1),
(2) Date: Mar. 25, 2021

(87) PCT Pub. No.: WO2020/065329
PCT Pub. Date: Apr. 2, 2020

(65) Prior Publication Data

US 2021/0393024 A1 Dec. 23, 2021

(30) Foreign Application Priority Data

Sep. 26, 2018 (GB) ..... 1815655

(51) Int. Cl.
*A46B 13/00* (2006.01)
*A46B 3/02* (2006.01)
(Continued)

(52) U.S. Cl.
CPC ..... *A46B 13/006* (2013.01); *A46B 3/02* (2013.01); *A46B 13/005* (2013.01); *A46B 13/02* (2013.01);
(Continued)

(58) Field of Classification Search
CPC ..... A46B 13/006; A46B 3/02; A46B 13/005; A46B 13/02; A46B 2200/3033; A47L 5/26; A47L 9/0477; A46D 1/0207; A46D 3/00
See application file for complete search history.

(56) References Cited

U.S. PATENT DOCUMENTS 2,533,169 A 12/1950 Macfarland
4,498,210 A 2/1985 Drumm
(Continued)

FOREIGN PATENT DOCUMENTS

CN 1555746 A 12/2004
CN 102106643 A 6/2011
(Continued)

OTHER PUBLICATIONS

Machine Translation of JP-H11123166-A, "Namura Translation" (Year: 1999).*
(Continued)

*Primary Examiner* — Monica S Carter
*Assistant Examiner* — Jonathan R Zaworski
(74) *Attorney, Agent, or Firm* — Tucker Ellis LLP

(57) ABSTRACT

A brush bar including a central core in the form of a rigid tube, a plurality of outwardly extending bristles in the form of at least one bristle strip, and a sealing material extending over substantially the entire remaining circumferential and axial extent of the brush bar, the at least one bristle strip having a root portion which is sandwiched between the sealing material and the central core or which is attached on top of the sealing material.

31 Claims, 9 Drawing Sheets

(51) Int. Cl.

| | |
|---|---|
| ***A46B 13/02*** | (2006.01) |
| ***A46D 1/00*** | (2006.01) |
| ***A46D 3/00*** | (2006.01) |
| ***A47L 5/26*** | (2006.01) |
| ***A47L 9/04*** | (2006.01) |

(52) U.S. Cl.

CPC ..... *A46D 1/0207* (2013.01); *A46D 3/00* (2013.01); *A47L 5/26* (2013.01); *A47L 9/0477* (2013.01); *A46B 2200/3033* (2013.01)

(56) References Cited

U.S. PATENT DOCUMENTS

| | | | | |
|---|---|---|---|---|
| 5,359,311 | A | 10/1994 | Kawabata et al. | |
| 5,588,172 | A * | 12/1996 | Biocca | A46B 13/005 15/207.2 |
| 9,320,399 | B2 * | 4/2016 | Ventress | A46B 9/026 |
| 10,004,370 | B2 * | 6/2018 | Isley | A47L 9/0422 |
| 10,786,127 | B2 | 9/2020 | Isley et al. | |
| 2011/0146009 | A1 * | 6/2011 | Marsh | A46B 3/08 15/21.1 |
| 2012/0198644 | A1 | 8/2012 | Iles | |
| 2016/0174792 | A1 * | 6/2016 | Williamson | A46B 13/00 15/383 |
| 2017/0209008 | A1 | 7/2017 | Isley et al. | |
| 2018/0255992 | A1 | 9/2018 | Isley et al. | |

FOREIGN PATENT DOCUMENTS

| | | | | |
|---|---|---|---|---|
| CN | 202027062 | U | 11/2011 | |
| CN | 102631170 | A | 8/2012 | |
| CN | 105592764 | A | 5/2016 | |
| CN | 106993985 | A | 8/2017 | |
| CN | 206934044 | U | 1/2018 | |
| DE | 1290919 | B | 3/1969 | |
| DE | 102015106094 | A1 * | 11/2016 | |
| DE | 202018101345 | U1 * | 4/2018 | A46B 13/006 |
| GB | 2551070 | A | 12/2017 | |
| JP | H9-313253 | A | 12/1997 | |
| JP | H11123166 | A * | 5/1999 | |
| JP | 3088566 | U | 9/2002 | |
| JP | 2002330904 | A * | 11/2002 | |
| JP | 2007330652 | A * | 12/2007 | |
| JP | 2008157573 | A * | 7/2008 | |
| JP | 2009011374 | A * | 1/2009 | |
| JP | 2009066031 | A * | 4/2009 | |
| JP | 2009131418 | A * | 6/2009 | |
| JP | 2009268684 | A * | 11/2009 | |
| JP | 4700226 | B2 * | 6/2011 | |
| JP | 2015070975 | A * | 4/2015 | |
| JP | 2016158779 | A * | 9/2016 | |
| KR | 10-2018-0029282 | A | 3/2018 | |

OTHER PUBLICATIONS

Machine Translation of JP 2015070975 to Terabe, "Terabe Translation" (Year: 2015).*

Machine Translation of DE 202018101345 to Fook. Fook Translation (Year: 2018).*

Office Action received for Chinese Patent Application No. 201980063085.9, mailed on Apr. 20, 2022, 21 pages. (12 pages of English Translation and 9 pages of Original Document).

Office Action received for Patent Application No. KR 10-2021-7011904, mailed on May 24, 2022, 14 pages (7 pages of English Translation and 7 pages of Original Document).

International Search Report and Written Opinion dated Jan. 3, 2020, directed to International Application No. PCT/GB2019/052724; 12 pages.

Search Report dated Feb. 18, 2019, directed to GB Application No. 1815655.4; 1 page.

Office Action and Search Report received for Chinese Patent Application No. 201980063085.9, mailed on Sep. 23, 2021, 15 pages (8 pages of English Translation and 7 pages of Original Document).

* cited by examiner

CLEANER HEAD FOR A VACUUM CLEANER

REFERENCE TO RELATED APPLICATIONS

This application is a national phase application under 35 USC 371 of International Application No. PCT/GB2019/052724, filed Sep. 26, 2019, which claims the priority of United Kingdom Application No. 1815655.4, filed Sep. 26, 2018, the entire contents of each of which are incorporated herein by reference.

FIELD OF THE DISCLOSURE

This invention relates to a cleaner head for a vacuum cleaner, and particularly, although not exclusively, relates to a cleaner head for a hand-held vacuum cleaner. The invention also relates to a brush bar for a cleaner head and to a method of manufacture of the brush bar.

BACKGROUND OF THE DISCLOSURE

Cleaner heads for vacuum cleaners typically comprise a brush bar located within a housing. A suction opening is provided in a lower surface of the housing, which is commonly known as a sole plate, through which dirt bearing air is drawn into the cleaner head.

A problem associated with conventional cleaner heads is that the close proximity required between the sole plate and the surface being cleaned in order to maintain pick-up performance means that large debris tends to be pushed across the surface being cleaned by the cleaner head rather than being drawn through the suction opening into the cleaner head.

Brush bars have been developed which try to rectify this problem. Such brush bars have a plurality of radially extending bristles and a sealing material disposed between the bristles. The sealing material is typically a "fleece" type material and extends over substantially the entire circumferential and axial extent of the regions of the brush bar between the bristles. The sealing material is locally deformable so that debris pressed into the material is at least partially enveloped by the material. The sealing material may also be resilient so that once debris has been extracted, the material returns to a nominal shape.

These brush bars have a core in the form of a rigid tube. The brush bar has a number of bristle strips spaced circumferentially about the core. Each bristle strip has a row of radially extending bristles which are held by an overmoulded locating strip. The overmoulding locating strip of each bristle strip is secured to the core within a corresponding groove provided in the outer surface of the core. Each groove has opposing lips along each edge of the groove which interlock with the locating strip to secure the bristle strip to the core.

Strips of a sealing material are secured to the outer surface of the core between the bristle strips.

Whilst these brush bars have helped to solve the problem mentioned above, they have the disadvantage that they are expensive and difficult to manufacture. The materials and manufacture method used also result in a brush bar with a circumference which is larger than desirable. Any brush bar or method of manufacture which helped to solve these problems would therefore be desirable.

SUMMARY OF THE DISCLOSURE

According to an aspect of the present invention there is provided a brush bar comprising a central core, in the form of a rigid tube, a plurality of outwardly extending bristles in the form of at least one bristle strip, and a sealing material extending over substantially the entire remaining circumferential and axial extent of the brush bar, characterised in that the at least one bristle strip has a root portion which is sandwiched between the sealing material and the central core, or which is attached on top of the sealing material. In an embodiment the root portion is fixed to the underside of the sealing material and the sealing material is fixed to an outer surface on the central core.

As used herein the term "rigid" means that the tube retains its tubular shape during normal use. It is preferably self-supporting. It may however have some ability to flex, give or compress.

Sandwiching a root portion between the sealing material and the central core (for example by fixing the root portion of the bristles directly to the underside of the sealing material and the sealing material directly to the central core) or fixing the root portion on top of the sealing material can be advantageous for several reasons. Firstly with the bristle strip(s) being secured using the sealing material, the brush bar may be simpler and cheaper to make as it does not require overmoulding a plastic locating strip onto the bristles or forming a channel in the surface of the central core into which the locating strip is placed. In addition, the brush bar can have a smaller wall thickness than the prior art brush bar (since it does not need to have sufficient depth to accommodate a channel for a locating strip). This means that the inner circumference of the central core can be increased if desired to house larger components inside it. A motor for powering rotation of the brush bar could for example be placed inside the central core. Alternatively the small wall thickness can be utilised to make smaller floor tools. This is particularly advantageous in some territories where there is a consumer demand for smaller, lighter machines.

The radial extent of the bristles may be equal to or greater than the radial extent of the sealing material. The bristles may tangential to the outer surface of the central core. They may for example, be arranged at an angle to the surface of the central core such that they point towards or away from the direction of travel of the brush bar during use. The bristles may be arranged perpendicular to the longitudinal axis of the central core. The radial extent of the bristles may be equal to or greater than the radial extent of the sealing material.

The sealing material may be a deformable material. In particular, the sealing material may be a resiliently deformable material. The sealing material may comprise a tufted material. The sealing material may be a fleece material. The sealing material may be a felt material. The sealing material may be formed from a polymer for example Nylon. The sealing material may have a backing material. The backing material may be made from a woven fabric, for example it may be formed from woven polyester or nylon. In an embodiment a layer of adhesive may be located on the underside of the sealing material and/or on the underside of the backing material. The underside of the sealing material and/or the underside of the backing material may have a coating which helps the adhesive to bond to it. In such as embodiment the adhesive can fix the sealing material to the central core. In an alternative embodiment the central core may have a layer of adhesive on its outer surface to which the sealing material is fixed. The sealing material could alternatively be fused to the central core by any other suitable method.

Any suitable adhesive may be used, for example a modified acrylic or acrylic adhesive tape.

The bristle strips may comprise bristles which have a stiffness which is greater than the stiffness of the sealing material in a radial direction. Suitable examples are glass fibre, basalt, Vectran™, nylon, or any suitable synthetic fibre. In an embodiment the bristles are carbon fibre bristles.

The diameter of each bristle may be not more than 0.5 mm, preferably not greater than 10 μm. The bristles may be arranged in a plurality of rows extending longitudinally with respect to the brush bar. The width of each row may be not greater than 5 mm, for example not greater than 2 mm. The rows of bristles may be arranged in a generally helical configuration extending around, or partially around, the brush bar. There may be 1, 2, 3, 4 or 5 bristle strips. The length of each bristle may be between 5 mm and 15 mm In an embodiment the sealing material may be formed from a plurality of strips with a bristle strip being attached to each sealing member. These pre-fabricated sealing member and bristle strip sections can then be fixed to the central core to effectively cover the entire surface of the central core.

In an alternative embodiment, neighbouring sealing members may be fixed together with a bristle strip fixed between them. Such pre-fabricated sealing member and bristle strip sections can then be fixed to the central core.

The root portion of the bristle strip(s) may be fixed to the sealing member by bonding, sewing, gluing, ultrasonic welding or any other suitable means. In a particular embodiment the root portion of the bristle strip is glued to the underside of the sealing member. In an alternative embodiment the root portion of the bristle strip(s) may be sewn to the sealing member. In a particular embodiment the root portion may extend under the sealing member. The root portion may extend only a short distance under the sealing member, for example from 0.1, or, 0.2, or 0.5, or 1 mm to 3, or 4, or 5, or 8, or 10 mm. In an alternative embodiment the root portion of the bristle strip may extend the full width of the sealing member. In an embodiment where the root portion of the bristle strip extends the full width of the sealing material, the upper surface of the root of the bristle strip is fixed to the lower surface of the sealing member and thus the root portion becomes a layer of the sealing material. In such an embodiment the upper surface of the root portion is fixed to the lower surface of the sealing material and the lower surface of the root portion is fixed to the central core such that the root portion conforms to the outer surface of the central core. The root portion and the bristles of the bristle strip(s) do not project into the central core. The outer surface of the central core is preferably smooth. In an embodiment the central core has no channels on its outer surface. In an embodiment the outer surface of the central core is smooth. The ends of the central core may have location features, such as notches or cut outs which can be used during manufacture of the brush bar, for example for drive dog fitment. Such location features may also be used for mounting the brush bar within a cleaner head. Additionally the central core may have end formed features for example, flanges and flares.

In an embodiment the central core is formed from a metal, for example from Aluminium. In an alternative embodiment the central core may be formed from a composite material such as carbon fibre, or a plastics material. The inner surface of the central core may be smooth and featureless or may have added, extruded or moulded features if desired.

According to a further aspect of the invention there is provided a cleaner head for a vacuum cleaner, comprising an agitator in the form of a brush bar as described above. The cleaner head may further comprise a housing defining a chamber which at least partially surrounds the brush bar and a dirty air inlet in a lower part of the chamber, the brush bar being supported for rotation with respect to the housing.

The cleaner head may be provided with a support for supporting the cleaner head on a surface being cleaned, the brush bar being arranged such that, in use, the bristles contact the surface being cleaned. The bristles may extend below the support.

The sealing material may be arranged such that, in use, the sealing material is spaced away from the surface being cleaned by the support.

The cleaner head may comprise a rear roller.

According to a further aspect of the invention there is provided a vacuum cleaner comprising a cleaner head as described above.

According to a further aspect of the invention there is provided a vacuum cleaner comprising a brush bar as described above.

According to a further aspect of the invention there is provided a method for making a brush bar, the method comprising the steps of;

1) providing a rigid tube;
2) providing a strip of sealing material;
3) providing a bristle strip having a root portion; and
4) fixing the strip of sealing material to the rigid tube, wherein that the root portion of the bristle strip is sandwiched between the underside of the sealing material and the outer surface of the rigid tube, or is attached on top of the strip of sealing material.

Accordingly, in this aspect of the invention either the strip of sealing material is fixed to the rigid tube such that the root portion of the bristle strip is sandwiched between the underside of the sealing material and the outer surface of the rigid tube, or the root portion of the bristle strip is attached on top of the strip of sealing material before, during or after the strip of sealing material is fixed to the rigid tube. In other words, according to this aspect of the invention, step 4 may comprise fixing the strip of sealing material to the rigid tube such that the root portion of the bristle strip is sandwiched between the underside of the sealing material and the outer surface of the rigid tube; or the method may comprise step 3a which comprises attaching the root portion of the bristle strip on top of the strip of sealing material, and step 4 may comprise fixing the strip of sealing material, to which the root portion of the bristle strip has been attached, to the rigid tube; or step 4 may comprise fixing the strip of sealing material to the rigid tube and the method may further comprise step 5 which comprises attaching the root portion of the bristle strip on top of the sealing material once the sealing material has been fixed to the rigid tube; or step 4 may comprise fixing the strip of sealing material to the rigid tube while simultaneously attaching the root portion of the bristle strip on top of the strip of sealing material.

As explained above, existing brush bars are manufactured by overmoulding the base of a bristle strip with a plastics or rubber material to form a locating strip. This locating strip is then secured into a corresponding groove provided in the outer surface of the rigid tube. Each groove has opposing lips along each edge of the groove which interlock with the locating strip to secure the bristle strip to the rigid tube. Strips of a sealing material are secured to the outer surface of the rigid tube between the bristle strips.

These brush bars are expensive and difficult to manufacture. The materials and manufacture method used also result in a brush bar with a circumference which is larger than desirable.

The method used in the present invention is advantageous as it can be much simpler and/or cheaper than the existing method, and/or can produce a brush bar which is lighter and has a thinner wall thickness. This means that the inner circumference of the central core can be increased if desired to house larger components inside it. A motor for powering rotation of the brush bar could for example be placed inside the central core. Alternatively the smaller wall thickness could be utilised to make smaller floor tools. This is particularly advantageous in some territories where there is a consumer demand for smaller, lighter machines.

In an embodiment the method further comprises the step of forming the rigid tube, for example by forming a rigid tube from a metal or plastics material. The method may comprise the step of forming the rigid tube from Aluminium.

The method may also further comprise the step of forming or cutting a strip of sealing material. In a particular embodiment the method involves the step of forming the sealing material from a deformable material, in particular, a resiliently deformable material. The sealing material may comprise a tufted material. The sealing material may be a fleece material. The sealing material may be a felt material. The sealing material may be formed from Nylon.

The method may further comprise the step of forming the sealing material with a backing material. The backing material may be made from a woven fabric, for example it may be formed from woven polyester or woven nylon. In an embodiment the method may also include the step of locating a layer of adhesive on the underside of the sealing material and/or on the underside of the backing material. Any suitable adhesive may be used, for example a modified acrylic. The adhesive may be in the form of a double sided adhesive tape.

The method may further comprise the step of applying a coating to the backing material before application of the adhesive. The coating may help the adhesive to bond to the backing material.

The method may also include the step of fixing the sealing material to the rigid tube using the adhesive. The adhesive may be applied to the underside of the sealing material, to the underside of the backing material or to the rigid tube. The adhesive can therefore be used to bond the sealing material to the rigid tube. Alternatively the sealing material could be fixed to the rigid tube in any suitable way, for example by fusing, melting or ultrasonic welding.

The method may further comprise the step of forming the bristle strip with a root portion, for example forming the bristle strip from carbon fibre. The method may include the step of forming the root portion of the bristle strip by weaving ends of the carbon fibre together.

In a particular embodiment the method comprises the step of fixing the root portion of the bristle strip to the sealing material before the sealing material is fixed to the outer surface of the rigid tube. This fixing may be carried out by gluing, adhering, fusing, bonding or sewing the root portion of the bristle strip to the underside of or the top of the sealing material. This fixing together forms a sealing material and bristle strip sheet.

The method may comprise the steps of 1) laying the sealing material and bristle strip sheet onto a jig, for example a vacuum bed having location detail; 2) attaching a drive dog to one or both ends of the rigid tube; and 3) rolling the rigid tube over the sealing material and bristle strip sheet to fix the sealing material and bristle strip sheet to the rigid tube.

Alternatively the method may comprise the steps of 1) attaching a drive dog to one or both ends of the rigid tube; and 2) bringing one end of the sealing material and bristle strip sheet into contact with the rigid tube; and 3) rotating the rigid tube to fix the sealing material and bristle strip sheet to the rigid tube.

Alternatively, the method may comprise the step of applying the sealing material and bristle strip sheet starting at one end of the rigid tube and fixing it along the length of the tube. The method may comprise the step of turning the rigid tube as the sealing material and bristle strip sheet is applied to the rigid tube. The sealing material and bristle strip sheet may be held, for example in a roll and the sheet may be applied by moving the rigid tube in the direction of its longitudinal axis to fix the sealing material and bristle strip sheet along the length of the rigid tube.

In any of these embodiments the one or more sealing material and bristle strip sheets may be applied to the rigid tube such that substantially the entire circumferential and axial extent of the rigid tube is covered.

It is also possible that the method may comprise the step of joining two or more sealing material and bristle strip sheets together before they are fixed to the rigid tube. In this embodiment two or more sealing material and bristle strip sheets may be joined together by gluing, stitching, adhering, fusing or bonding them together such that sealing material is located between each bristle strip. In a particular method an adhesive, for example an adhesive backing tape is used to join sealing material and bristle strip sheets together by applying the adhesive tape to the underside of a backing material of the sealing members. In an alternative embodiment the backing material of two strips of sealing material can be sewn together with the root portion of a bristle strip being located between the two pieces of backing material. In a particular method the backing material that is stitched together protrudes outwardly from the edge of the sealing material. The method therefore comprises the step of forming the sealing material with a backing material having an edge which protrudes outwardly from the remainder of the sealing material. The root potion of the bristle strip can then be fixed to the underside or to the top of this protruding portion.

As an alternative to joining two or more sealing material and bristle strip sheets together before fixing them to the rigid tube, the method may include forming a sealing material and bristle strip sheet which comprises more than one bristle strip and/or more than one strip of sealing material. Such a sealing material and bristle strip sheet may comprise, for example, two or three strips of sealing material and two bristle strips.

The step of forming the sealing material and bristle strip sheet may include forming a sealing material and bristle strip sheet which has a strip of sealing material at each end thereof. Accordingly, when the sealing material and bristle strip sheet is wrapped around a core, the gap or join between ends of the sealing material and bristle strip sheet has sealing material on both sides of it. The gap or joint may therefore be partially or completely visually obscured by the sealing material.

Where a sealing material and bristle strip sheet comprises more than one strip of sealing material, the step of forming the sealing material and bristle strip sheet may include providing at least two strips of sealing material on a communal piece of backing material. In such a case, the communal piece of backing material may sandwich a root portion of a bristle strip between it and the core, or one or more bristle strips may have their root portions attached on top of the communal piece of backing material.

Optional or preferred features described in relation to one aspect of the invention may be applied to other aspects of the invention, where appropriate.

BRIEF DESCRIPTION OF THE FIGURES

In order to better understand the present invention, and to show more clearly how the invention may be put into effect, the invention will now be described, by way of example, with reference to the following drawings.

DETAILED DESCRIPTION OF THE DISCLOSURE

Figure 1:
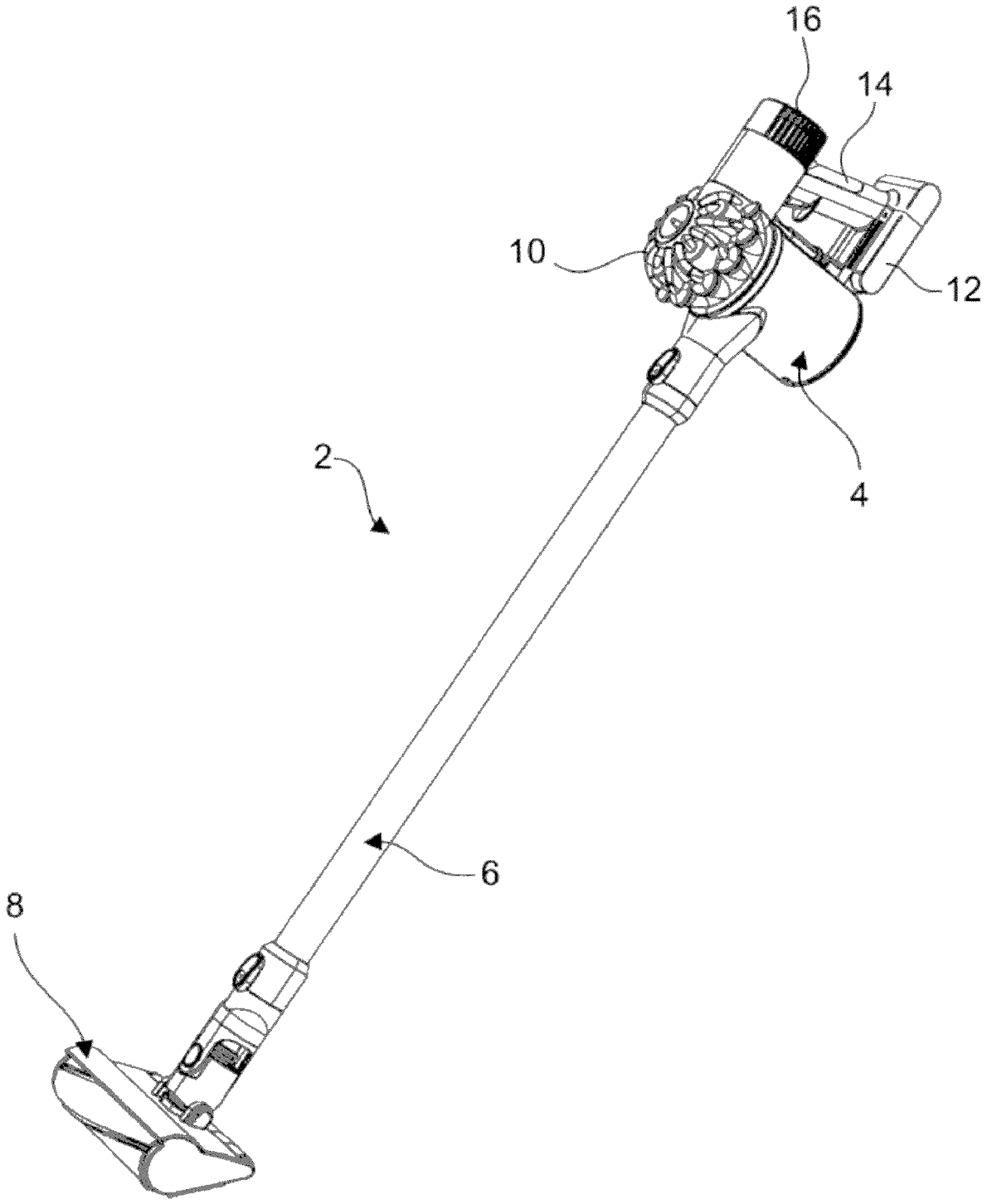
FIG. 1 is a perspective view of a hand-held vacuum cleaner.

FIG. 1 shows a hand-held vacuum cleaner 2 comprising a main body 4, a wand 6 and a cleaner head 8.

The main body 4 comprises a separating system 10, in the form of a cyclonic separator, a motor and impeller (not visible) arranged to draw air through the separating system 10, and a power supply 12, in the form of a battery, for powering the motor. The main body 4 has a handle 14 which is gripped by a user, and a clean air outlet 16 through which air that has passed through the separating system 10 is discharged.

The wand 6 is attached at one end to the main body 4 and at the other end to the cleaner head 8. The wand 6 provides fluid communication between the cleaner head 8 and the separating system 10, and supports the cleaner head 8 during use.

Figure 2:
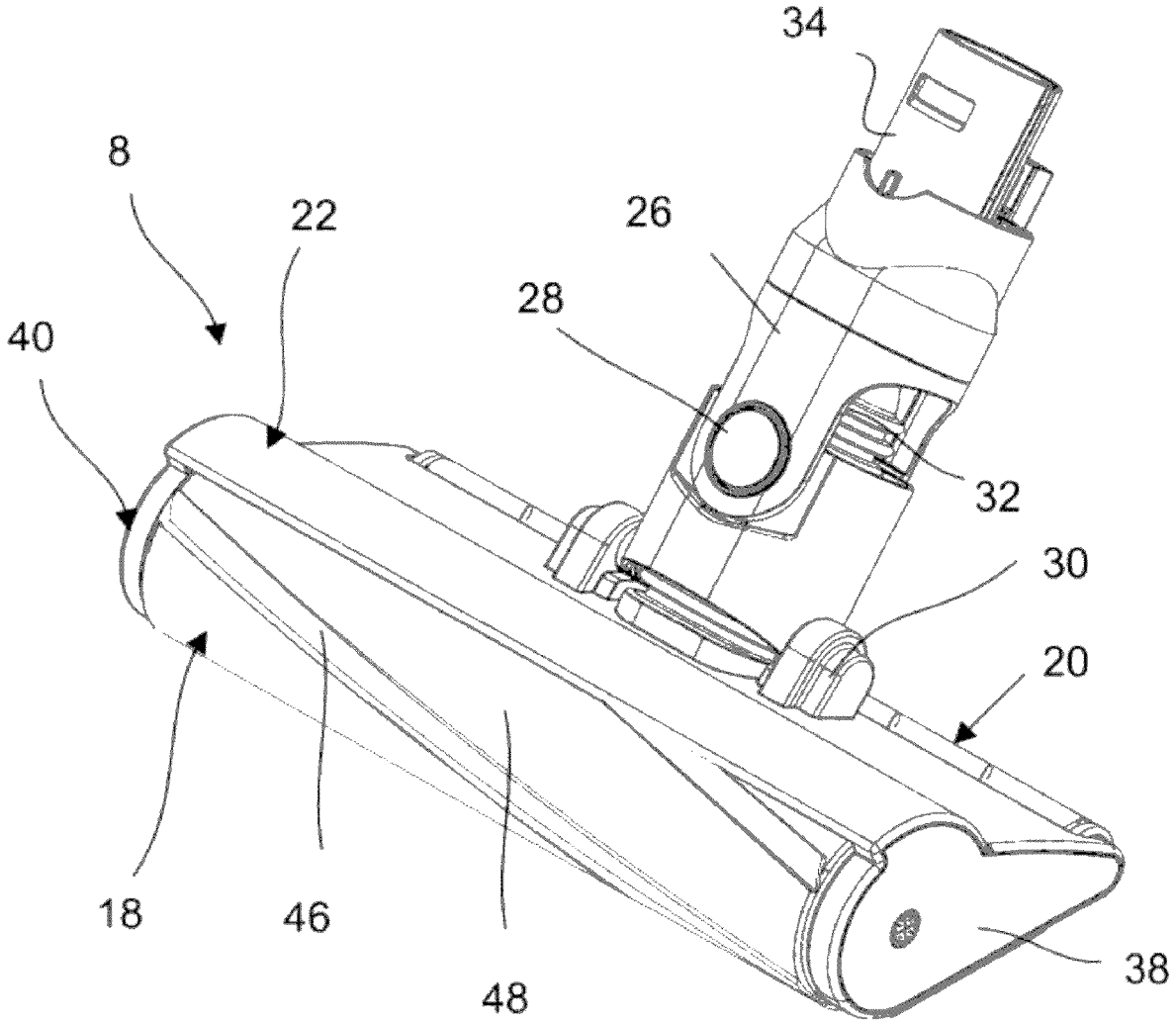
FIG. 2 is a perspective view of the cleaner head of the vacuum cleaner shown in FIG. 1.
Figure 3:
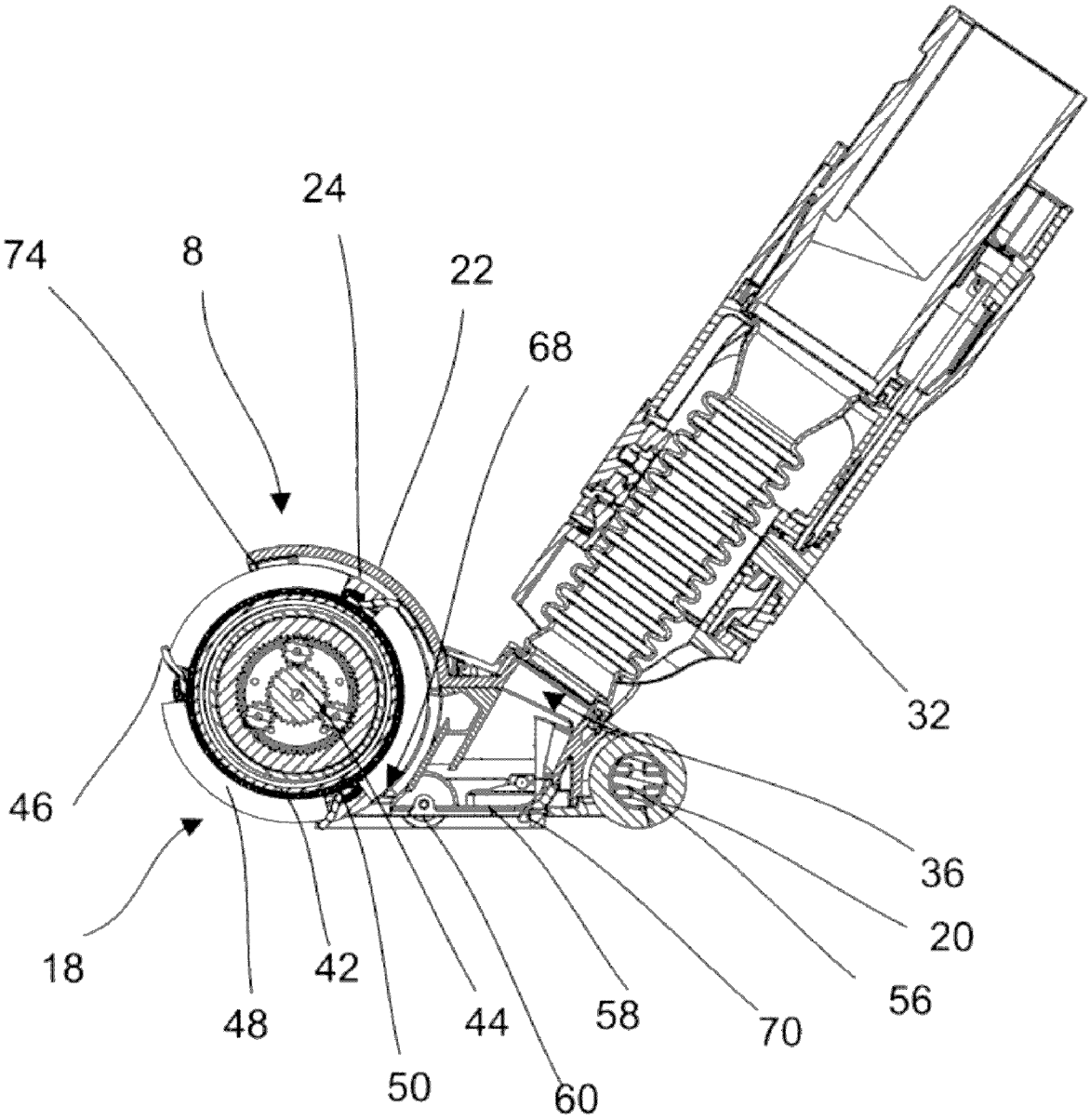
FIG. 3 is a sectional side view of the cleaner head shown in FIG. 2.

FIGS. 2 and 3 show the cleaner head 8 in isolation. The cleaner head 8 comprises an agitator in the form of a brush bar 18, a rear roller 20, and a housing 22 which defines a chamber 24 within which the brush bar 18 and the rear roller 20 are at least partially disposed.

The housing 22 is connected to the wand 6 by a pivoting arrangement 26 comprising upper and lower pivotal joints 28, 30 which enable the cleaner head 8 to be pivoted in yaw and pitch with respect to the wand 6. A flexible hose 32 extends from a connecting portion 34 of the pivoting arrangement 26 into an upper region of the chamber 24. The end of the hose 32 that extends into the chamber 24 defines a dirty air outlet 36 (shown in FIG. 3) from the chamber 24 through which air is drawn into the wand 6 and through the separating system 10.

The brush bar 18 and the rear roller 20 are supported at each of their respective ends by side walls 38, 40 of the housing 22. The brush bar 18 and the rear roller 20 are each rotatably supported by the side walls 38, 40 so that they can rotate with respect to the housing 22.

Figure 5:
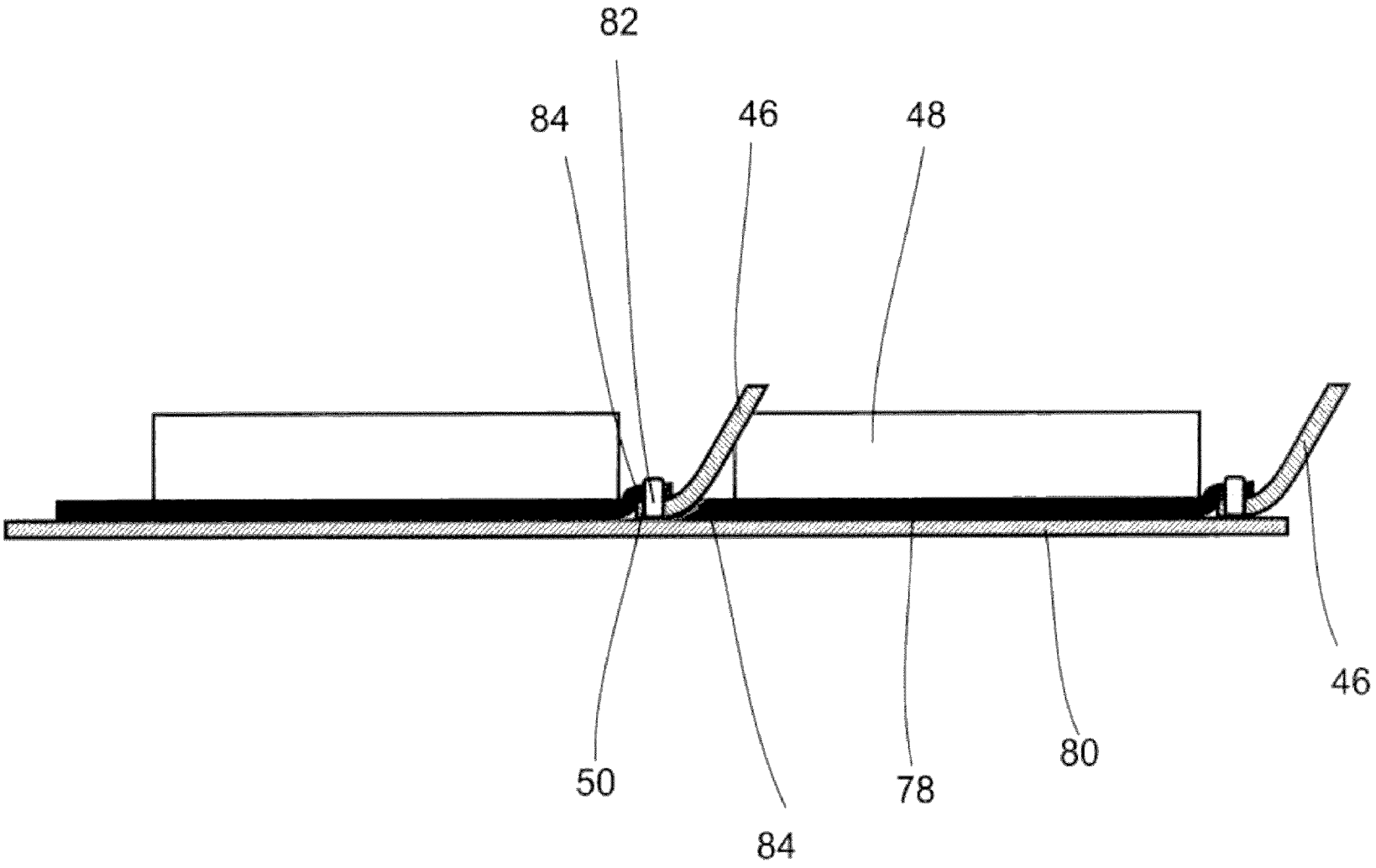
FIG. 5 is a schematic view of a further alternative sealing material and bristle strip sheet.
Figure 6:
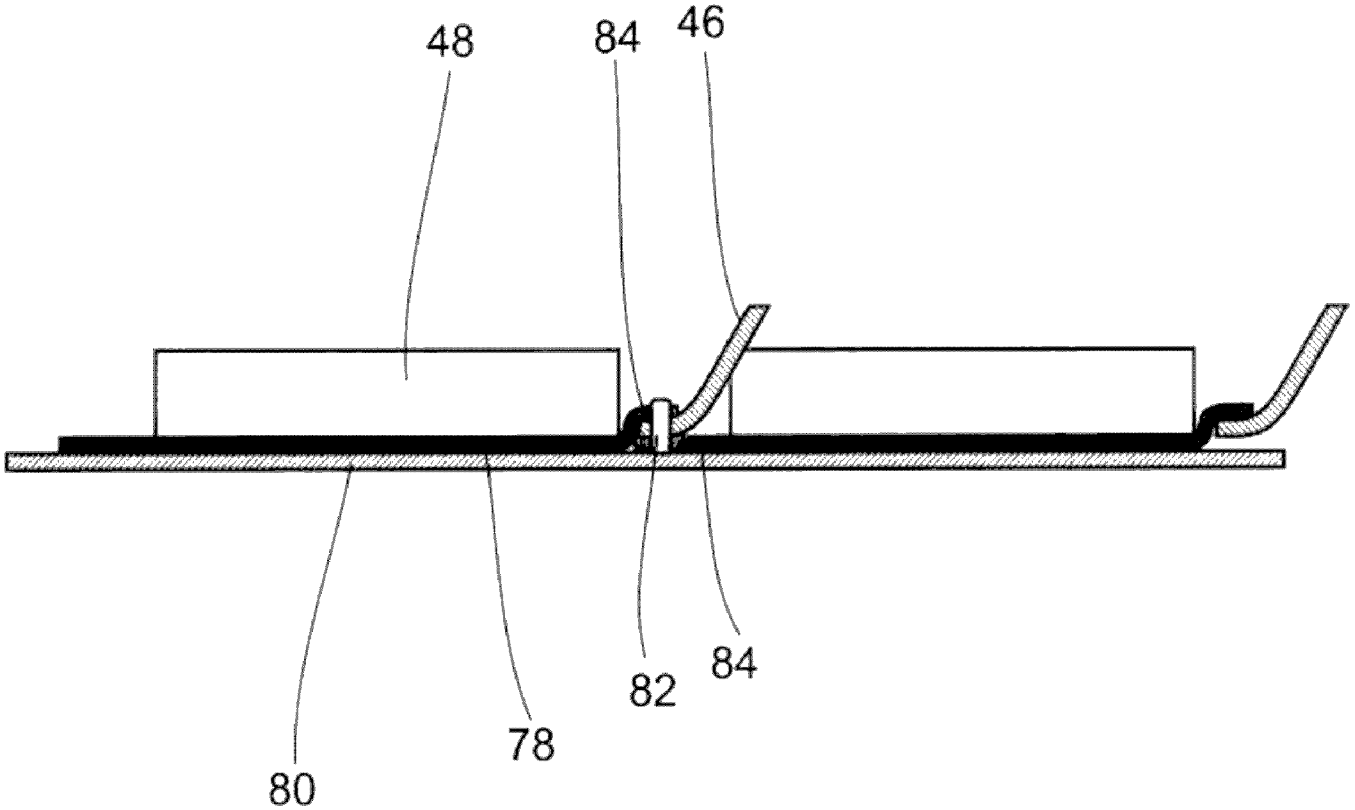
FIG. 6 is a schematic view of a further alternative sealing material and bristle strip sheet.

With reference to FIG. 3, the brush bar 18 comprises a core 42 in the form of a rigid tube within which a brush bar motor (not shown) and a transmission 44 are disposed. The motor and the transmission 44 are arranged to drive the brush bar 18. The brush bar 18 comprises three bristle strips 46 spaced circumferentially about the core 42. The bristle strips 46 are spaced apart from each other by the same separation angle, in the example 120 degrees. Each bristle strip 46 comprises a row of outwardly extending bristles which are fixed to a neighbouring strip of sealing material 48. The bristle strips 46 are fixed to a lower surface of the sealing material 48. The sealing material 48 is preferably a strip of sealing material 48 and has the shape of a parallelogram, for example a rectangle. The bristle strips 46 are fixed to the lower surface of the sealing material 48 along one long edge of the sealing material 48. The bristles strips 46 may be sewn to the sealing material 48 or may instead be glued, fused, bonded or adhered to the sealing material by any suitable means. The bristles on the bristle strips 46 may be densely packed, or spaced apart either in clumps or individually. The bristle strips 46 have a root portion 50 by which the bristle strips 46 are fixed to the sealing material 48. The strips of sealing material 48 with the bristle strips 46 attached form sealing material and bristle strip sheets, embodiments of which are shown in FIGS. 4 to 6, these will be described in more detail below.

Each bristle strip 46 extends both longitudinally and circumferentially with respect to the brush bar 18 in a generally helical configuration. Each bristle strip 46 extends circumferentially through an angle of 120 degrees over the length of the brush bar 18.

The sealing material 48 is locally deformable so that debris pressed into the material is at least partially enveloped by the material. The sealing material 48 may also be resilient so that once debris has been extracted, the material returns to a nominal shape. However, it will be appreciated that centrifugal forces acting on the brush bar 18 during use may return the sealing material 48 to its nominal shape.

In the embodiment shown, the sealing material 48 is a tufted material. The sealing material 48 may, for example, be a tufted material having a short dense pile and may be formed by filaments woven to a fabric substrate. The filaments of the pile may be made from nylon, or other suitable material having a relatively low stiffness. The stiffness of a tufted sealing material will depend on the elastic properties of the material, the filament diameter, filament length and pile density. In the embodiment shown, the tufted material is made from nylon and has a filament diameter of between 30 μm and 50 μm (preferably 30 μm), a filament length of 0.005 m and a pile density of 60,000 filaments/25 $mm^2$. The sealing material need not be a tufted material, but could be a foam material such as a closed cell foam material or other suitable material that provides adequate flow restriction. It will be appreciated that although a deformable sealing material is preferred, this is not essential. The thickness (i.e. radial depth) of each strip of sealing material 48 is substantially constant, and the sealing strips 48 are substantially identical.

The bristles of each bristle strip 46 are arranged at an angle to the surface of the core 42 such that they point towards or away from the direction of travel of the brush bar 18 during use. The bristle strips 46 are all angled in the same direction. Preferably they point away from the direction of travel. The bristles are arranged perpendicular to the longitudinal axis of the core 42. The radial extent of the bristle strips 46 is greater than the radial extent of the strips of sealing material 48. That is, the radial distance between the tips of the bristle strips 46 and the rotational axis of the brush bar 18 is greater than the radial distance between the periphery of the strips of sealing material 48 and the rotational axis of the brush bar 18. The radius of the brush bar 18 is defined as the distance between the axis of the brush bar 18 and the tips of the bristle strips 46. The bristle strips 46 may be angled to the extent that they make contact with a neighbouring strip of sealing material 48.

Each strip of sealing material 48 may extend over an angle of 100 to 120 degrees, preferably 110 to 120 degrees of the circumferential extent of the brush bar 18. A gap may be formed between one or more of the bristle strips 46 and an adjacent strip of sealing material 48. Alternatively the strips of sealing material 48 may abut the bristle strips 46 so that no gaps are provided between the strips of sealing material 48 and the bristles.

Fewer or more bristle strips 46 may be provided, in which case a corresponding number of strips of sealing material 48 are used. For example, two or four bristle strips 46 may be provided.

The bristles of the bristle strips 46 are preferably made from a material which is stiffer than the sealing material 48 disposed between the bristle strips 46. The bristle strips 46 may comprise carbon fibre filaments having a thickness of between 5 μm and 10 μm, preferably 7 μm. In the embodiment shown, the carbon fibre filaments are 8 mm in length and the bristle density (i.e. the number of filaments per millimetre in length of the bristle strips 46) of the bristle strips 46 is 12 000 bristles per 10 mm. The bristles are arranged in bundles that are spaced apart from each other in the longitudinal direction of each bristle strip 46. There are 6 bundles per 10 mm of the length of each bristle strip 46.

The rear roller 20 comprises a core 56 in the form of a solid shaft wrapped in a strip of a tufted material. The tufted material may be the same as the tufted material of the brush bar 18.

The underside of the housing 22 is open. In the embodiment shown, the housing 22 comprises a rear sole plate 58 which extends transversely with respect to the cleaner head 8 from one of the side walls 38, 40 of the housing 22 to the other. A support in the form of wheels 60 are supported by the sole plate 58. The wheels 60 are set into the sole plate 58 so that only a lower portion of each wheel 60 protrudes from the sole plate 58.

The wheels 60 support the cleaner head 8 on a surface being cleaned such that the sole plate 58, the side walls 38, 40 and the strips of sealing material 48 are spaced from the surface. In the embodiment shown, the brush bar 18 is arranged such that strips of sealing material 48 are spaced from the surface being cleaned by an amount that provides clearance of the strips of sealing material 48 from the surface, but which does not impair the sealing effectiveness between the strips of sealing material 48 and the surface.

The sole plate 58 and the side walls 38, 40 are spaced further from the surface being cleaned than the strips of sealing material 48. A rear sealing strip 70 is therefore provided along the underside of the sole plate 58. Side sealing strips (not shown) are also provided along the lower edges of the side walls 38, 40. The sealing strips are arranged to seal against the surface being cleaned during use. The sealing strips 70 may comprise a material having a pile, for example a tufted fabric/brush-like fabric having filaments made of a suitable material, such as nylon.

The housing 22 has an upper front edge 74 which extends transversely with respect to the cleaner head 8. The upper front edge 74 is above the rotational axis of the brush bar 18 and below the top of the brush bar 18. The brush bar 18 extends forwards of the upper front edge 74. The upper front edge 74 and the front edges of the side walls 38, 40 define a front opening of the chamber 24.

The inner surface of a front region of the housing 22 which defines part of the chamber 24 curves over the top of the brush bar 18. The radius of curvature of the inner surface of the chamber 24 corresponds to the radius of the tips of the bristle strips 46. The front region of the housing 22 adjacent the front edge 74 provides a guard which prevents debris from being flung upwardly and/or forwardly by the brush bar 18 during use. However, it will be appreciated that in alternative embodiments the housing need not be arranged as a guard and need not extend forwardly of the top of the brush bar 18. It will be appreciated that a small clearance may be provided to prevent interference between the tips of the bristles and the housing 22. The brush bar 18 is arranged so that the sealing material 48 restricts flow between the brush bar 18 and the inner surface of the housing adjacent the front edge 74.

In use, the cleaner head 8 of the vacuum cleaner 2 is placed on a floor, for example a floor having a hard surface. The cleaner head 8 is supported on the surface by the rollers 60 so that the sealing strips 70 together with the lower periphery of the sealing material 48 of the brush bar 18, seal against the surface being cleaned. The chamber 24 is therefore sealed around the periphery of the dirty air inlet 68 by the sealing strips 70, and the sealing material 48 of the brush bar 18. In addition, the brush bar 18 seals against the upper inner surface of the housing 22 adjacent the front edge 74.

In the context of the specification, the term "seal" should be understood to mean capable of maintaining a predetermined pressure difference during use of the vacuum cleaner 2. For example, the chamber 24 can be regarded as being sealed provided that the flow of air through the chamber 24 is restricted to an amount that is sufficient to maintain a pressure difference of at least 0.65 kPa between the inside of chamber 24 and ambient during normal use (e.g. when used to clean a hard/firm surface). Similarly, the brush bar 18 can be considered to be sealed against the housing 22 if the flow of air through the front opening is restricted by the brush bar 18 such that a pressure difference of at least 0.65 kPa between the inside of chamber 24 and ambient is maintained during normal use.

The motor and the impeller draw air into the chamber 24 through the dirty air inlet 68 in the housing 22 and upwardly through the dirty air outlet 36, through the wand 6 and into the separating system 10. Dirt is extracted from the air by the separating system 10 before being exhausted through the clean air outlet 16.

The brush bar 18 is driven in a forward direction which is the counter-clockwise direction in FIG. 3. The brush bar 18 is driven at a relatively high rotational speed, for example between 600 rpm and 3000 rpm, preferably between 600 rpm and 1400 rpm. Increasing the rotational speed can be expected to improve fine dust pick up performance.

As the cleaner head 8 is moved across the surface being cleaned, the tips of the bristles of the bristle strips 46 contact the surface and sweep debris rearwardly towards the dirty air inlet 68. The bristles are particularly effective at removing fine dust from crevices and agitating dust that has been compacted on the surface being cleaned.

As the cleaner head 8 is moved over large debris (i.e. debris that is larger than the clearance between the periphery of the sealing material 48 and the floor), for example grains of rice, oats, pasta, cereals or similar, the sealing material 48 is deformed locally by the debris.

Local deformation of the sealing material 48 ensures that, for most large debris, the cleaner head 8 does not ride-up over the debris, which would reduce sealing effectiveness between the sealing strips 70, the sealing material 48 on the brush bar 18 and the floor surface. Sealing between the brush bar 18 and the surface being cleaned is therefore not adversely affected, and so effective pick-up performance is maintained. The large debris, which has been substantially enveloped by the sealing material 48, is then released rearwardly to be picked up by the dirty air inlet 68 and passed through the dirty air outlet 36 to the separating system 10, as described above.

It will be appreciated that the sealing material 48 also deforms to accommodate small variations in the surface being cleaned without causing scratching of the surface.

The cleaner head 8 is effective at picking up both small and large debris as well as dust that has been compacted. The cleaner head 8 is particularly effective on hard floors in which large debris stands proud of the surface, or on which dust has been compacted.

The method of manufacture of the brush bar shown in FIGS. 1 to 3 will now be described in more detail in relation to FIGS. 4 to 7.

In a particular embodiment the method comprises the step of fixing the root portion 50 of the bristle strip 46 to the sealing material 48 before the sealing material 48 is fixed to the outer surface of the core 42. This fixing of the bristle strip 46 to the sealing material 48 may be carried out by gluing, adhering, fusing, bonding or sewing the root portion of a bristle strip 46 to the underside of a strip of the sealing material 48. The fixing together of these components forms a sealing material and bristle strip sheet.

One or more sealing material and bristle strip sheets may then be applied to the core 42 such that substantially the entire circumferential and axial extent of the core 42 is covered.

Figure 4A:
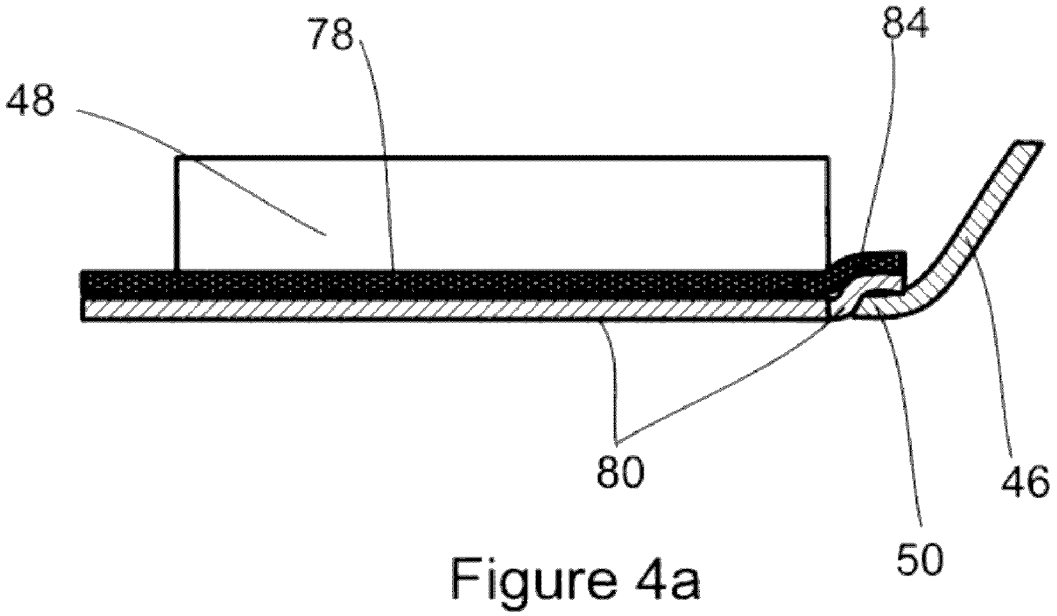
FIG. 4*a* is a schematic view of a sealing material and bristle strip sheet shown in FIGS. 2 and 3.
Figure 4B:
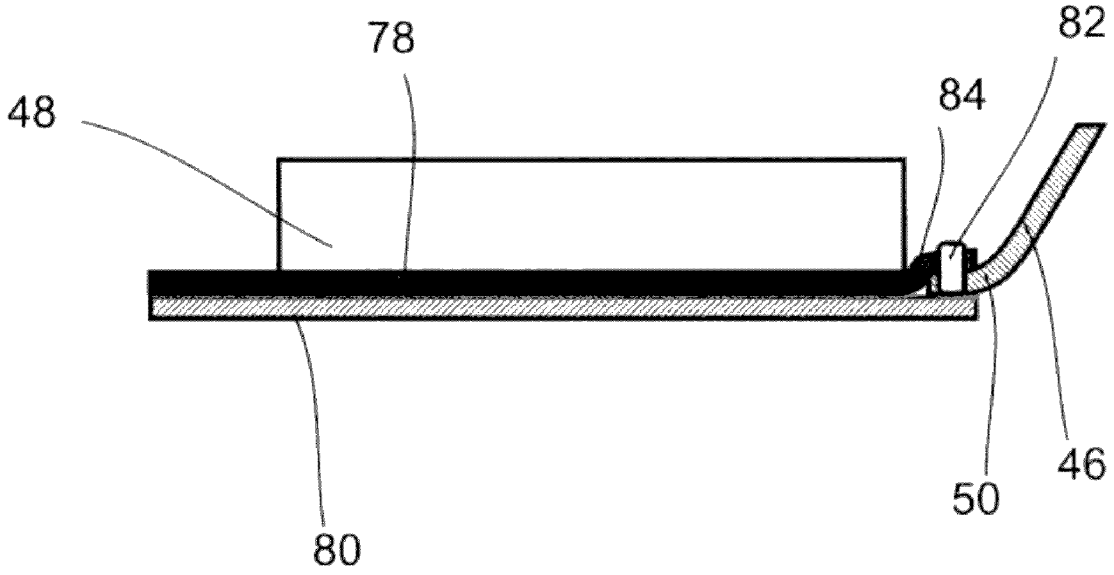
FIG. 4*b* is a schematic view of an alternative sealing material and bristle strip sheet.

In FIG. 4*a* it can be seen that the root portion 50 is positioned beneath the adhesive tape 80 but it could be located between the sealing material 48 and the adhesive tape 80. In FIG. 4*b* it can be seen that instead of adhering the root portion 50 of the bristle strip 46 to the sealing material 48, stitching 82 is used to fix the root portion 50 of the bristle strip 46 to the sealing member 48. The root portion may be adhered or stitched to a backing material projection 84 or it may be adhered or stitched to the remainder of the sealing material.

It is also possible that the method may comprise the step of joining two or more sealing material and bristle strip sheets together before they are fixed to the core 42. This results in larger sheets having multiple strips of sealing material and multiple bristle strips. Examples of these embodiments are shown in FIGS. 5 and 6. In these embodiments two or more sealing material and bristle strip sheets may be joined together by gluing, stitching, adhering, fusing or bonding them together. As shown in FIG. 5, an adhesive, for example an adhesive tape 80 is used to join two sealing material and bristle strip sheets together by applying the adhesive tape 80 to the underside of the backing material 78 of the sealing members 48. In this embodiment it can be seen that the root portions 50 of the bristle strips 46 have been stitched 82 to the backing material projections 84 of one of the strips of sealing material 48. The adhesive 80 is then used to join two sealing material and bristle strip sheets together.

In an alternative embodiment, as shown in FIG. 6, the backing material 78 of two strips of sealing material 48 can be stitched 82 together with the root portion 50 of a bristle strip 46 being located between the two pieces of backing material 78. An adhesive, for example an adhesive tape 80 can then be applied to the underside of the sealing material 48.

The core 42 may be formed by moulding, for example by machining, casting, extruding or moulding from a metal or plastics material.

The sealing material 48 may formed by any suitable method and once made is preferably cut or formed into strips, for example rectangular or parallelogram shaped strips. The sealing material 48 is preferably formed from a tufted material, for example a fleece or felt material, for example nylon.

The method may further comprise the step of forming the bristle strip 46 with a root portion 50, for example forming the bristle strip 46 from carbon fibre. The method may include the step of forming the root portion 50 of the bristle strip 46 by weaving ends of the carbon fibre together.

The method may also include the step of fixing the sealing material 48 to the core 42 using an adhesive. The adhesive may be applied to the underside of the sealing material 48, to the underside of the backing material 78 or to the core 42. The adhesive can therefore be used to bond the sealing material and bristle strip sheets to the core 42.

The method may comprise the steps of 1) laying the sealing material 48 and bristle strip 46 sheet onto a jig, for example a vacuum bed having location detail (not shown); 2) attaching a drive dog (not shown) to one or both ends of the core 42; and 3) rolling the core 42 over the sealing material and bristle strip sheet to fix the sealing material and bristle strip sheet to the core.

Alternatively the method may comprise the steps of 1) attaching a drive dog to one or both ends of the core 42; and 2) bringing one end of the sealing material and bristle strip sheet into contact with the core; and 3) rotating the core to fix the sealing material and bristle strip sheet to the core 42.

Figure 7:
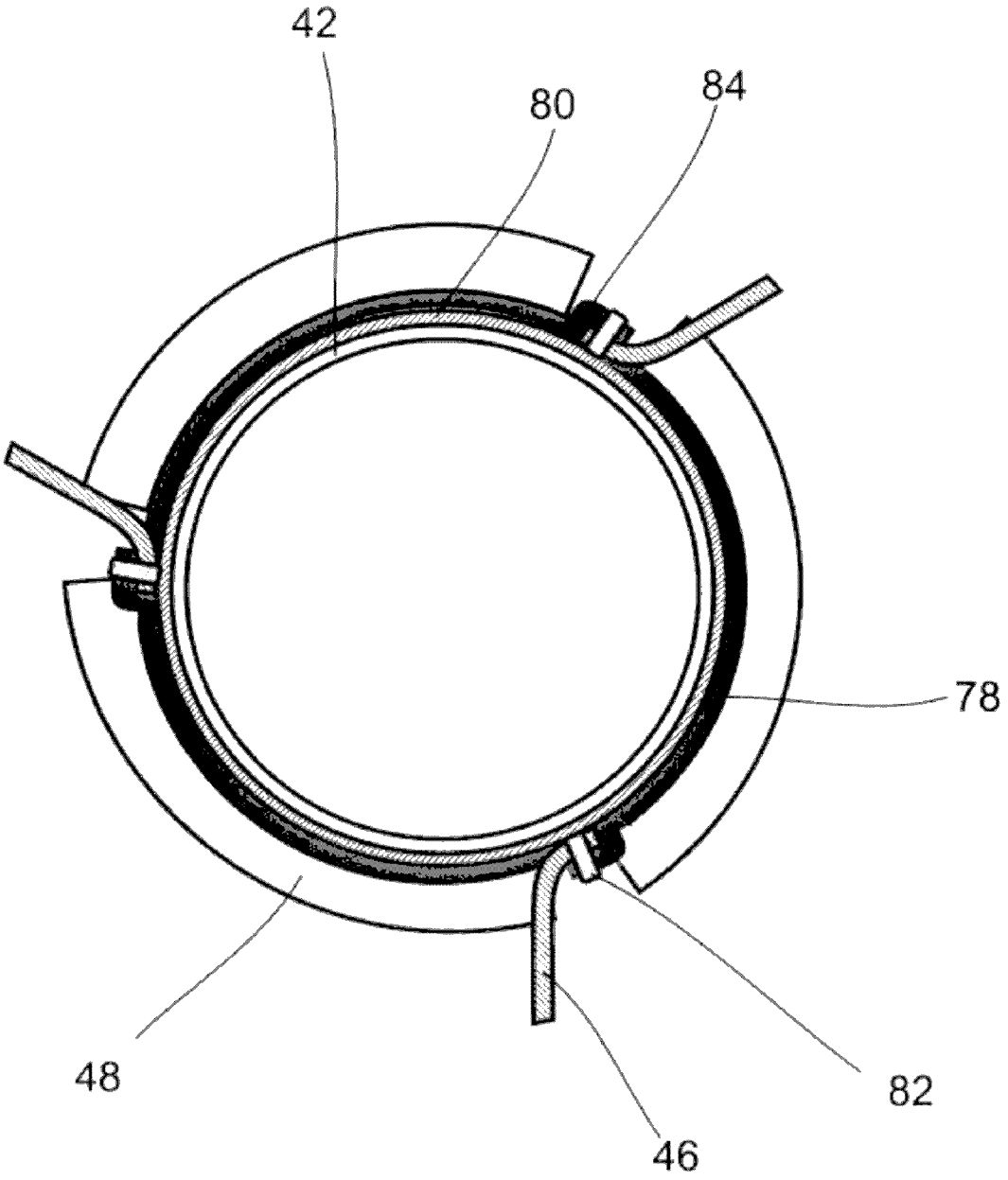
FIG. 7 is schematic side view a brush bar having the sealing material and bristle strip sheet shown in FIG. 5.

Alternatively the method may comprise the step of applying the sealing material and bristle strip sheet starting at one end of the core 42 and fixing it along the length of the core 42. The method may comprise the step of rotating the core as the sealing material and bristle strip sheet is applied to the core 42. The sealing material and bristle strip sheet may be held, for example in a roll and the sheet may be applied by moving the core 42 in the direction of its longitudinal axis to fix the sealing material and bristle strip sheet along the length of the core. Once the sealing material and bristle strip sheet has been fixed to the core 42 it will be as shown in FIG. 7. This brush bar can then be fitted to the cleaner head 8 of a vacuum cleaner as shown in FIGS. 1 to 3.

Figure 8:
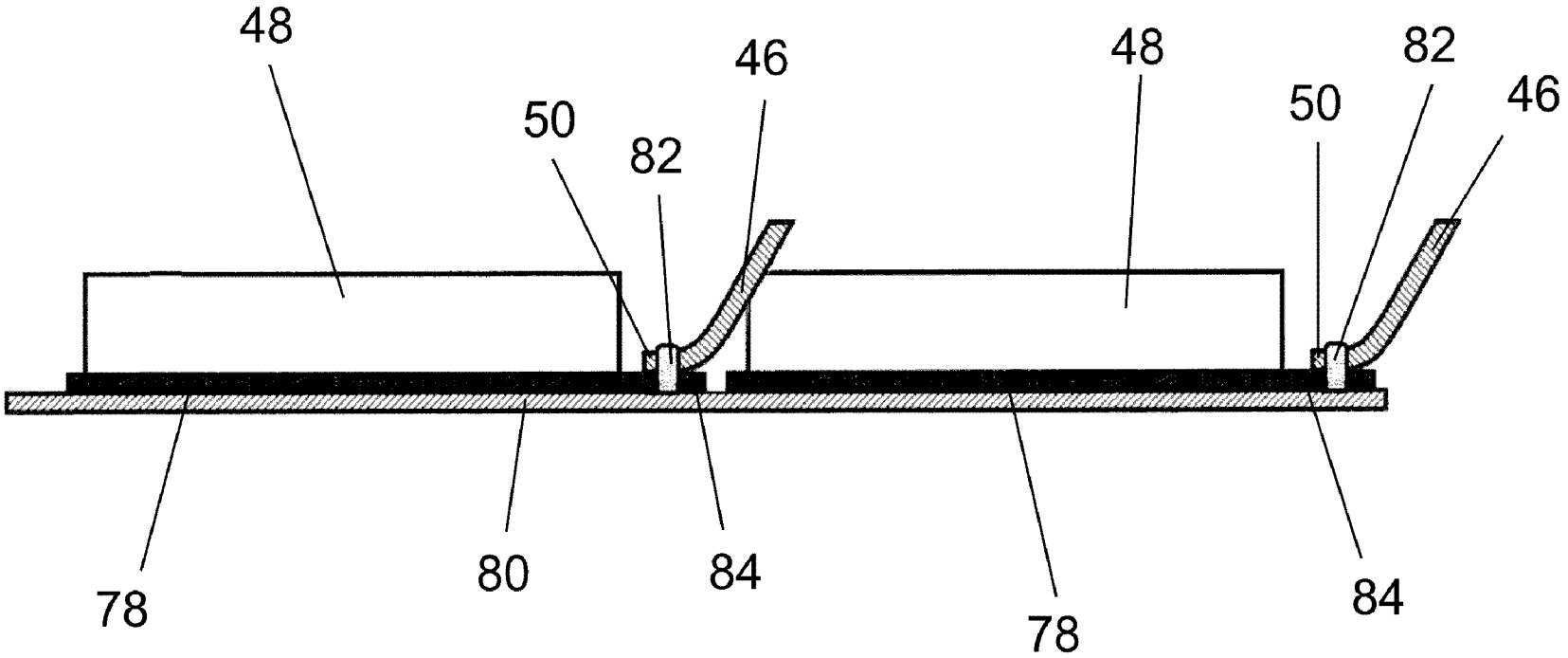
FIG. 8 is a schematic view of two of a further alternative sealing material and bristle strip sheet.

It is noteworthy that in each of the above embodiments, the root portions of the bristle strips are sandwiched beneath the sealing material. However, in other embodiments the bristle strips may be attached on top of the sealing material. FIG. 8 shows one such embodiment. This embodiment is similar to previous embodiments, therefore only the differences will be described here.

In this embodiment, two sealing material and bristle strip sheets are provided separately on a continuous piece of adhesive tape 80. Each sealing material and bristle strip sheet has a strip of sealing material 48 with a piece of backing material 78, and a bristle strip 46 the root portion 50 of which is secured on top of a backing material projection 84 of the backing material 78 (and thus on top of the sealing material as a whole) by stitching 82.

In this embodiment, the bristle strips 46 are attached to their respective strips of sealing material 48, and to form a brush bar the complete sealing material and bristle strip sheets are then attached to a rigid core in generally the same manner as described above. In some other embodiments, however, the same structure of brush bar could be achieved by first fixing the strips of sealing material 48 to the core and then stitching the root portions 50 of the bristle strips 46 on top (for instance using a curved needle).

Figure 9:
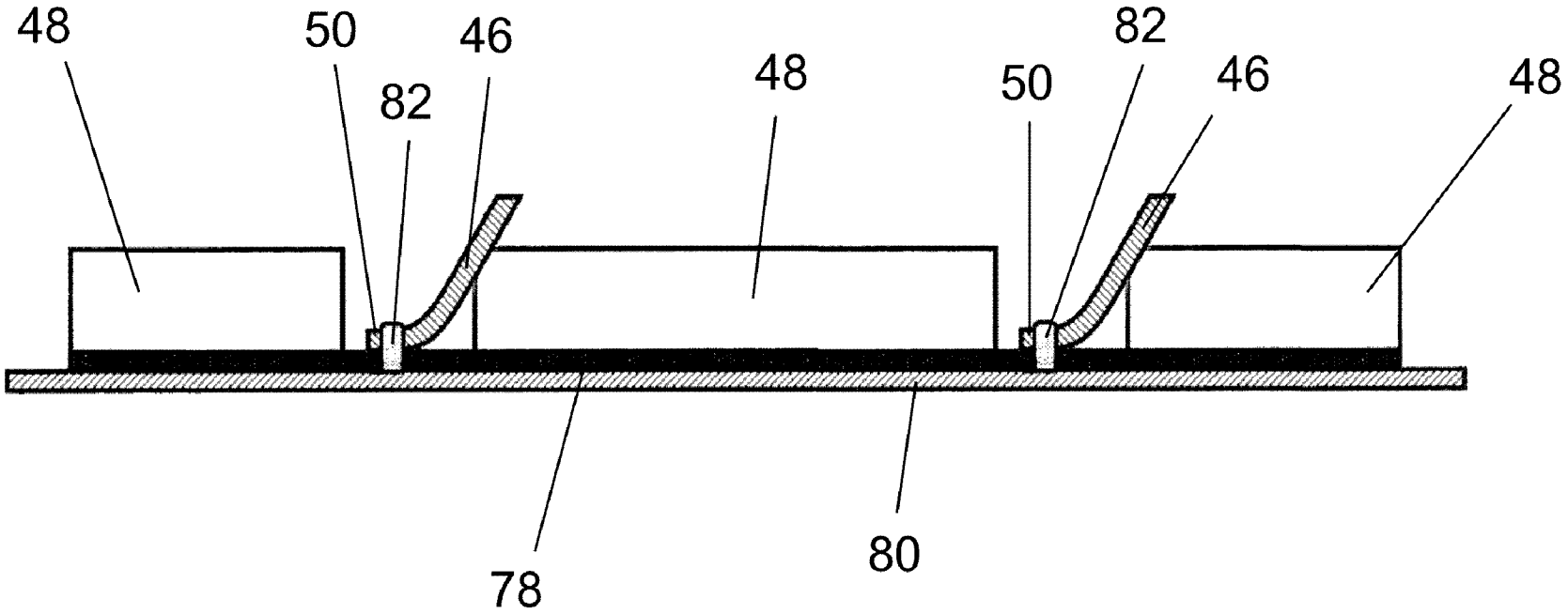
FIG. 9 is a schematic view of a further alternative sealing material and bristle strip sheet.

FIG. 9 shows a further embodiment in which the root portions 50 of bristle strips 46 are fixed on top of strips of sealing material 48 is shown in FIG. 9. In this embodiment, a single sealing material and bristle strip sheet is produced which has more than one strip of sealing material 48 and also more than one bristle strip 46. More particularly, in this embodiment the sealing material and bristle strip sheet has three strips of sealing material 48 and two bristle strips 46.

In this case, all three strips of sealing material 48 share a communal piece of backing material 78, with the two bristle strips 46 having their root portions 50 stitched to the backing material 78 in the gaps between the three strips of sealing material 48. A brush bar according to this embodiment may be considered a further example of a brush bar in which neighbouring strips of sealing material are fixed together with a bristle strip fixed between them.

It is noteworthy that in this embodiment the sealing material and bristle strip sheet has a strip of sealing material at each end (i.e. the upper and lower ends from the perspective of FIG. 9). When the sealing material and bristle strip sheet is wrapped around a core, these ends abut or terminate in close proximity to one another, and the corresponding strips of sealing material 48 behave to some extend like a single strip of sealing material, and visually obscure the joint or gap. The finished brush bar can therefore have a more uniform appearance.

The invention claimed is:

1. A brush bar comprising:

a central core in the form of a rigid tube;

a plurality of outwardly extending bristles in the form of at least one bristle strip, the at least one bristle strip comprising a root portion and a tip portion opposite to the root portion;

a first strip of sealing material separately formed from the central core and extending over a first portion of the brush bar; and a second strip of sealing material separately formed from the central core and extending over a second portion of the brush bar different than the first portion of the brush bar, the second strip of sealing material being completely spaced apart from the first strip of sealing material in a circumferential direction, wherein the root portion of the at least one bristle strip radially underlies and is directly fixed to an innermost surface of the first strip of sealing material, and wherein the tip portion of the at least one bristle strip radially and directly overlies an outermost surface of the second strip of sealing material, wherein the root portion is sandwiched between the innermost surface of the first strip of sealing material and an outer surface of the central core such that the root portion is tangential to the outer surface of the central core, and wherein a remaining portion of the at least one bristle strip extends away from the outer surface of the central core.

2. The brush bar of claim 1, wherein the radial extent of the tip portion of the at least one bristle strip is greater than the radial extent of the outermost surface of the second strip of sealing material.

3. The brush bar of claim 1, wherein the remaining portion of the at least one bristle strip extends away from a longitudinal axis of the central core, and wherein the plurality of outwardly extending bristles of the at least one bristle strip are arranged at an angle to an outer surface of the central core such that they point away from the direction of travel of the brush bar during use.

4. The brush bar of claim 1, wherein the first and second strips of sealing material each comprise a resiliently deformable material.

5. The brush bar of claim 1, wherein a layer of adhesive fixes the first strip of sealing material and the second strip of sealing material to the central core.

6. The brush bar of claim 1, wherein the bristles have a stiffness which is greater than the stiffness of the first strip of sealing material in a radial direction.

7. The brush bar of claim 1, wherein the bristles are formed from carbon fibre.

8. The brush bar of claim 1, further comprising a third strip of sealing material and a second bristle strip having a root portion and a tip portion, wherein the root portion of the second bristle strip is attached to an innermost surface of the second strip of sealing material, and wherein the tip portion of the second bristle strip directly and radially overlies an outermost surface of the third strip of sealing material.

9. The brush bar of claim 8, further comprising a third bristle strip having a root portion and a tip portion, wherein the root portion of the third bristle strip is attached to an innermost surface of the third strip of sealing material, and wherein the tip portion of the third bristle strip directly and radially overlies an outermost surface of the first strip of sealing material.

10. The brush bar of claim 1, wherein the root portion of the at least one bristle strip is fixed to the innermost surface of the first strip of sealing material by gluing or sewing.

11. The brush bar of claim 1, wherein the root portion of the at least one bristle strip extends from 0.1 to 10 mm underneath the innermost surface of the first strip of sealing material.

12. The brush bar of claim 1, wherein the root portion of the at least one bristle strip extends under a full width of the first strip of sealing material.

13. A cleaner head for a vacuum cleaner comprising the brush bar of claim 1.

14. A vacuum cleaner comprising the cleaner head of claim 13.

15. The brush bar of claim 1, wherein the at least one bristle strip is angled and contacts the second strip of sealing material.

16. The brush bar of claim 1, wherein no portion of the at least one bristle strip directly and/or radially underlies the second strip of sealing material.

17. The brush bar of claim 1, wherein the root portion is arranged radially closer to the central core than the tip portion.

18. The brush bar of claim 1, wherein the at least one bristle strip curves radially outwards from the root portion towards the tip portion.

19. The brush bar of claim 1, wherein a portion between the root portion and the tip portion of the at least one bristle strip contacts the second strip of sealing material.

20. A brush bar comprising:

a central core in the form of a rigid tube;

a first strip of sealing material arranged on the central core;

a second strip of sealing material arranged on the central core and circumferentially spaced apart from the first strip of sealing material;

a third strip of sealing material arranged on the central core and circumferentially between the first and second strips of sealing material, wherein the third strip of sealing material is circumferentially spaced apart from the first strip of sealing material and from the second strip of sealing material;

a first bristle strip formed from a first plurality of outwardly extending bristles, the first bristle strip comprising a root portion and a tip portion opposite to the root portion, wherein the root portion of the first bristle strip is arranged radially and directly under an innermost surface of the first strip of sealing material and is sandwiched between the innermost surface of the first strip of sealing material and an outer surface of the central core such that the root portion of the first bristle strip is fixed to the innermost surface of the first strip of sealing material and is tangential to the outer surface of the central core, wherein a remaining portion of the first bristle strip extends away from the outer surface of the central core, the tip portion of the first bristle strip directly and radially overlying an outermost surface of the second strip of sealing material; and a second bristle strip formed from a second plurality of outwardly extending bristles, the second bristle strip comprising a root portion and a tip portion opposite to the root portion, wherein the root portion of the second bristle strip is arranged radially and directly under an innermost surface of the second strip of sealing material and is sandwiched between the innermost surface of the second strip of sealing material and the outer surface of the central core such that the root portion of the second bristle strip is fixed to the innermost surface of the second strip of material and is tangential to the outer surface of the central core, wherein a remaining portion of the second bristle strip extends away from the outer surface of the central core, the tip portion of the second bristle strip directly and radially overlying an outermost surface of the third strip of sealing material.

21. The brush bar of claim 20, further comprising:

a third bristle strip formed from a third plurality of outwardly extending bristles, the third bristle strip comprising a root portion and a tip portion opposite to the root portion, wherein the root portion of the third bristle strip is arranged radially and directly under an innermost surface of the third strip of sealing material such that the root portion of the third bristle strip is fixed to the innermost surface of the third strip of material, and wherein the tip portion of the third bristle strip directly and radially overlies an outermost surface of the first strip of sealing material.

22. The brush bar of claim 20, wherein no part of the first bristle strip underlies the second strip of sealing material.

23. The brush bar of claim 20, wherein the first bristle strip continuously extends from the root portion to the tip portion such that the first bristle strip has one curved portion as the first bristle strip radially protrudes outwards from the innermost surface of the first strip of sealing material.

24. The brush bar of claim 20, wherein the root portion of the first bristle strip is directly fixed to the innermost surface of the first strip of sealing material.

25. The brush bar of claim 20, further comprising an adhesive layer arranged radially between the root portion of the first bristle strip and the innermost surface of the first strip of sealing material.

26. The brush bar of claim 20, further comprising a backing material arranged radially between the root portion of the first bristle strip and the innermost surface of the first strip of sealing material.

27. The brush bar of claim 26, further comprising an adhesive layer arranged radially between the root portion of the bristle strip and the central core.

28. A cleaner head for a vacuum cleaner comprising the brush bar of claim 20.

29. A brush bar comprising:

a central core in the form of a tube;

a plurality of bristle strips, each bristle strip being formed from a plurality of outwardly extending bristles, wherein each bristle strip comprises a root portion and a tip portion opposite to the root portion; and a plurality of sealing material strips formed separately from the central core and separately from the plurality of bristle strips, wherein each sealing material strip is arranged on the central core and is circumferentially spaced apart from an adjacent sealing material strip on the central core, wherein a bristle strip of the plurality of bristle strips is arranged circumferentially between the adjacent sealing material strips of the plurality of sealing material strips, wherein the root portion of each bristle strip is directly and radially sandwiched between an innermost surface of one of the sealing material strips of the plurality sealing material strips and an outer surface of the central core such that the root portion of each bristle strip is tangential to the outer surface of the central core, wherein remaining portions of each bristle strip extend away from the outer surface of the central core, and wherein the tip portion of each bristle strip directly and radially overlies an outermost surface of an adjacent sealing material strips such that each sealing material strip of the plurality of sealing material strips directly and radially overlies a root portion of a bristle strip of the plurality of bristle strips and directly and radially underlies a tip portion of a different bristle strip of the plurality of bristle strips.

30. The brush bar of claim 29, wherein the root portion of each bristle strip is directly fixed to the innermost surface of one of the sealing material strips.

31. A cleaner head for a vacuum cleaner comprising the brush bar of claim 29.

* * * * *